United States Patent [19]

Le Cacheux et al.

[11] Patent Number: 4,571,898

[45] Date of Patent: Feb. 25, 1986

[54] SALES BOUTIQUE, ESPECIALLY A NEWSPAPER KIOSK

[75] Inventors: Paul Le Cacheux; Andre Schuch; Alain C. Perrot, all of Paris, France

[73] Assignee: Ville de Paris, Paris, France

[21] Appl. No.: 447,637

[22] Filed: Dec. 7, 1982

[30] Foreign Application Priority Data

Dec. 8, 1981 [FR] France ..... 81 22944

[51] Int. Cl.[4] ..... A47B 5/00

[52] U.S. Cl. ..... 52/36; 52/65; 52/246; 40/554

[58] Field of Search ..... 52/65, 236.2, 236.1, 52/246, 247, 245, 72, 74, 64, 62, 79.4, 79.1; 49/71, 40, 114, 366; 186/52, 57; 109/19; 40/554

[56] References Cited

U.S. PATENT DOCUMENTS

| | | | |
|---|---|---|---|
| 580,707 | 4/1897 | O'Meara | 40/554 |
| 1,171,346 | 2/1916 | Rose | 52/65 |
| 1,728,134 | 9/1929 | Petta | 52/246 X |
| 1,921,652 | 1/1933 | Bohnert | 49/40 X |
| 3,105,315 | 10/1963 | Snethen | 40/554 X |
| 3,145,918 | 8/1964 | Higgins | 109/19 X |
| 4,174,594 | 11/1979 | Panzini | 52/65 |

FOREIGN PATENT DOCUMENTS

| | | | |
|---|---|---|---|
| 2300403 | 10/1976 | France | 52/79.4 |

*Primary Examiner*—Carl D. Friedman
*Assistant Examiner*—Creighton Smith
*Attorney, Agent, or Firm*—Fidelman, Wolffe & Waldron

[57] ABSTRACT

The invention relates to a sales boutique, especially a newspaper kiosk.

The technical problem posed consists of creating such a boutique which enables effective protection of the products and provides an excellent appearance.

According to the invention, this boutique is formed of a cell (I) fixed on a plinth (2) and comprising, over at least a part forming a facade, articulated members (I2) which can be brought from a closed position, in which they define a unified external surface integrated with the external surface of the rest of the body (4) of the cell, to an open position, in which they define and protect a display space, and the inverse.

The main utilization of the invention resides in boutiques for sale of newspapers, magazines, periodicals or books.

23 Claims, 5 Drawing Figures

3
6
III
III
48
7
19
4
1
8
10
12
II
II
11
14
34
29
15
IV
IV
25
5
2

SALES BOUTIQUE, ESPECIALLY A NEWSPAPER KIOSK

The present invention relates to a sales boutique, especially a newspaper kiosk for exhibiting and selling newspapers and similar publications, of the kind installed on public highways and consisting of a cell disposed on a plinth and having a door.

Certainly, such boutiques for displaying and selling this kind of article are known, and are usually installed in places where a lot of the public pass, such as squares, pavements of the streets of towns, and so on, and offer to passers-by newspapers, periodicals, books and others, disposed on one or more display surfaces. Besides the fact that such displays are often exposed to the wind, it is to be noted that they are formed in large majority from rudimentary means, which are unattractive and above all are extremely sensitive to weather and especially the action of wind and rain. Indeed, such kiosks usually consist of a fixed construction, whose facade opening forming a sales desk is bordered by an improvised wind-shield (canvas, plastics cloth and the like), on or against which are disposed or even piled the articles for sale, and which catch the wind and/or can come undone.

Thus, this type of ordinary sales boutique is characterized by its total lack of attractive appearance and homogeneity, its almost complete lack of proofing and protection of the books and newspapers, and even by a certain relative insecurity, that is to say in reality by its perfectly illogical aspect from many points of view.

For this reason, the object of the present invention is to remedy these disadvantages by providing a sales boutique of the kind described above whose design is both logical and attractive. This problem is solved according to the invention due to the fact that in a sales boutique, especially a newspaper kiosk for exhibiting and selling newspapers and similar publications, of the kind installed on the public highway and consisting of a cell disposed on a plinth and having a door, this cell is composed, at least in a part forming a facade, of articulated members which can be brought from a closed position, in which they define a unified external surface integrated with the external surface of the rest of the body of the cell, to an open position, in which they define and protect a display space, and the inverse. This arrangement ensures perfectly the protection of the newspapers which can be lodged in a display space encompassed between panels solid with the very structure of the boutique, which can also be closed in such a way that the closed surface of the boutique is uniform; moreover this contributes to the appearance of the boutique both in the open state, where no additional or disparate display member is visible nor added, as well as in the closed state.

According to a characteristic of the invention, in a sales boutique of the kind comprising a fixed sales counter, it is provided that this counter is solid with the body of the cell, at the level of the facade which can be opened or closed by the articulated panels, and extending horizontally and laterally on the surround inside the cell to form a protected display zone.

According to another characteristic of the invention, the boutique comprises an additional display shelf which is removable and retractable beneath the sales counter and may be extended horizontally out between the vertical articulated panels in the open position and retracted inside the body of the cell when said panels are closed. Moreover, according to another characteristic of the invention, the boutique comprises a removable and retractable horizontal awning which may be extended horizontally out between the panels in the open position and retracted inside the body of the cell in the closed position. It is clear that all these arrangements contribute advantageously to improving both the protection of the newspapers and the appearance of the boutique, as well as the security of the boutique and its homogeneous aspect.

By way of non-limitative example, a preferred embodiment of a sales boutique in accordance with the invention is described below and illustrated schematically in the accompanying drawings, in which.

Figure 1:
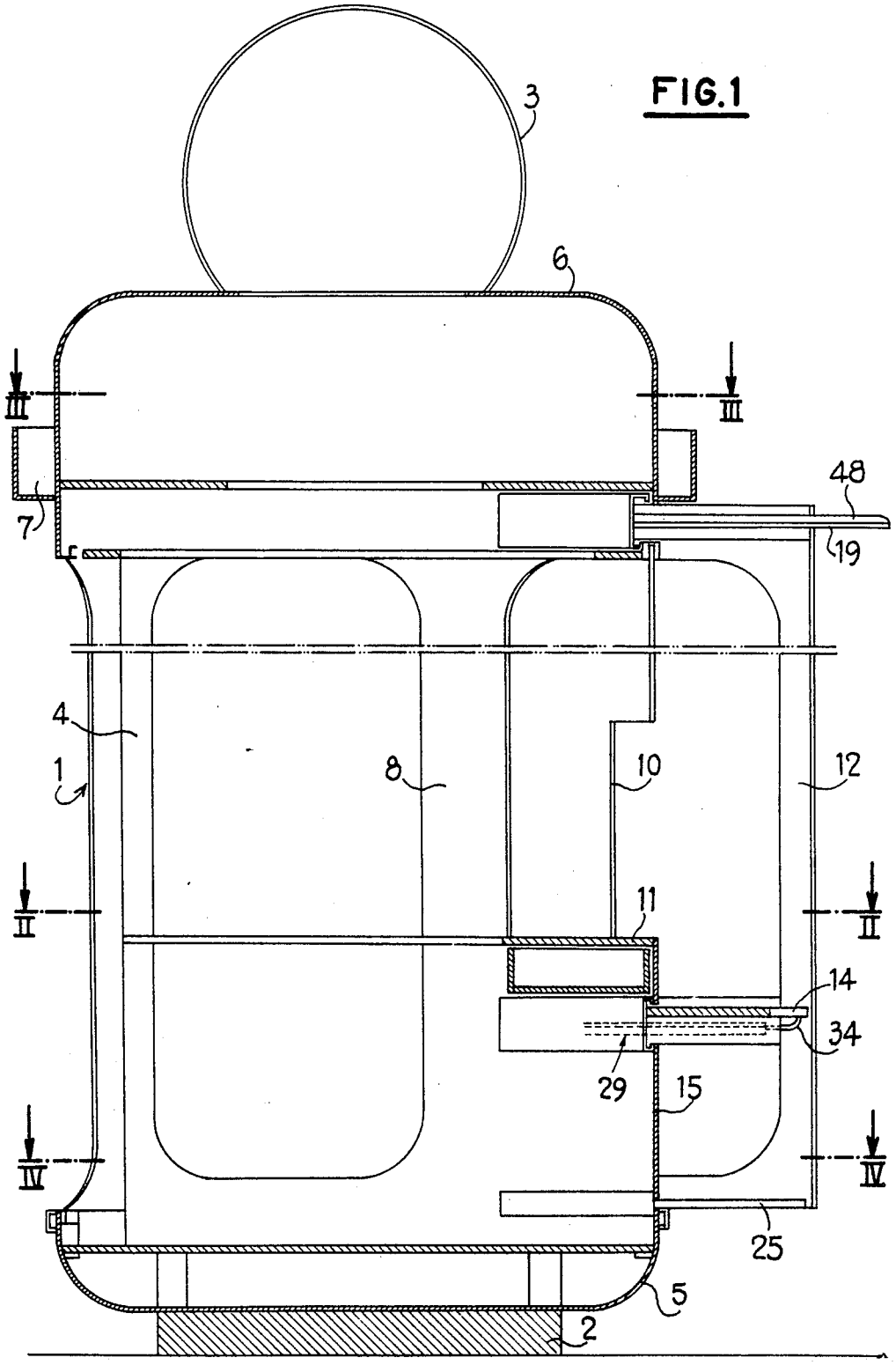
FIG. 1 is a side elevational sectional view of a boutique in accordance with the invention.

In FIG. 1, it is seen that the sales boutique comprises a cell indicated generally by the reference 1, resting on a plinth 2 and bearing at its upper part a movable transparent sphere 3 which may be used for a kinetic display of advertising material or including the name of the articles for sale in the boutique, such as "newspapers" or a generic name such as "Press". The cell 1 itself comprises a vertical body 4 of generally cylindrical shape connected in its bottom part to a base 5 in the shape of a flattened circular cup solid with the plinth 2, and in its top part to a roof member 6 in the general shape of an over-turned circular cup on which is mounted the globe 3 and which carries on its surround about half-way up a gutter 7.

The body 4 of the cell 1 comprises an opaque wall made of suitable material which resists weathering, such as metal, painted metal, hard plastics, wood, and so on, and comprises vertical elongate windows 8 of generally rectangular shape in its sides and facade, and a door 9 (FIGS. 2 to 4) situated at the rear side. The fascade window 8 also comprises an aperture 10 disposed at the level of the article sales desk. The door and windows are preferably made from a transparent material such as plexiglass or the like.

Below the aperture 10 defining the sales desk is disposed a fixed horizontal sales counter 11, disposed inside the body 4 of the cell, that is to say within the limit of the facade window 8, whose aperture 10 may be closed by a transparent shutter (not shown) sliding in front of it. Additionally, the door 9 is formed by a transparent panel sliding in sliders of ordinary type (not shown) which may be arranged in the edge of the base 5 and in the edge of the roof member 6. As may be seen in FIG. 2, this counter 11 is extended inside laterally along the inner wall of the body 4 and the side windows 8.

The facade window 8, which also comprises an aperture 10, is closed using members 12 in the shape of vertical elongate panels connected by hinges 13 (FIGS. 2 to 4) with vertical axes to the rest of the body 4 of the cell 1. The panels 12 can be brought from a closed position, disposed against the facade window 8 which also comprises an aperture 10, said panels 12 in said closed position defining a unified outer surface integrated with the outer surface of the body 4, to an open position (seen in FIGS. 2 to 5), said panels 12 in said open position defining and protecting a display space from the elements of weather, said display space being more fully described in the specification below.

Figure 2:
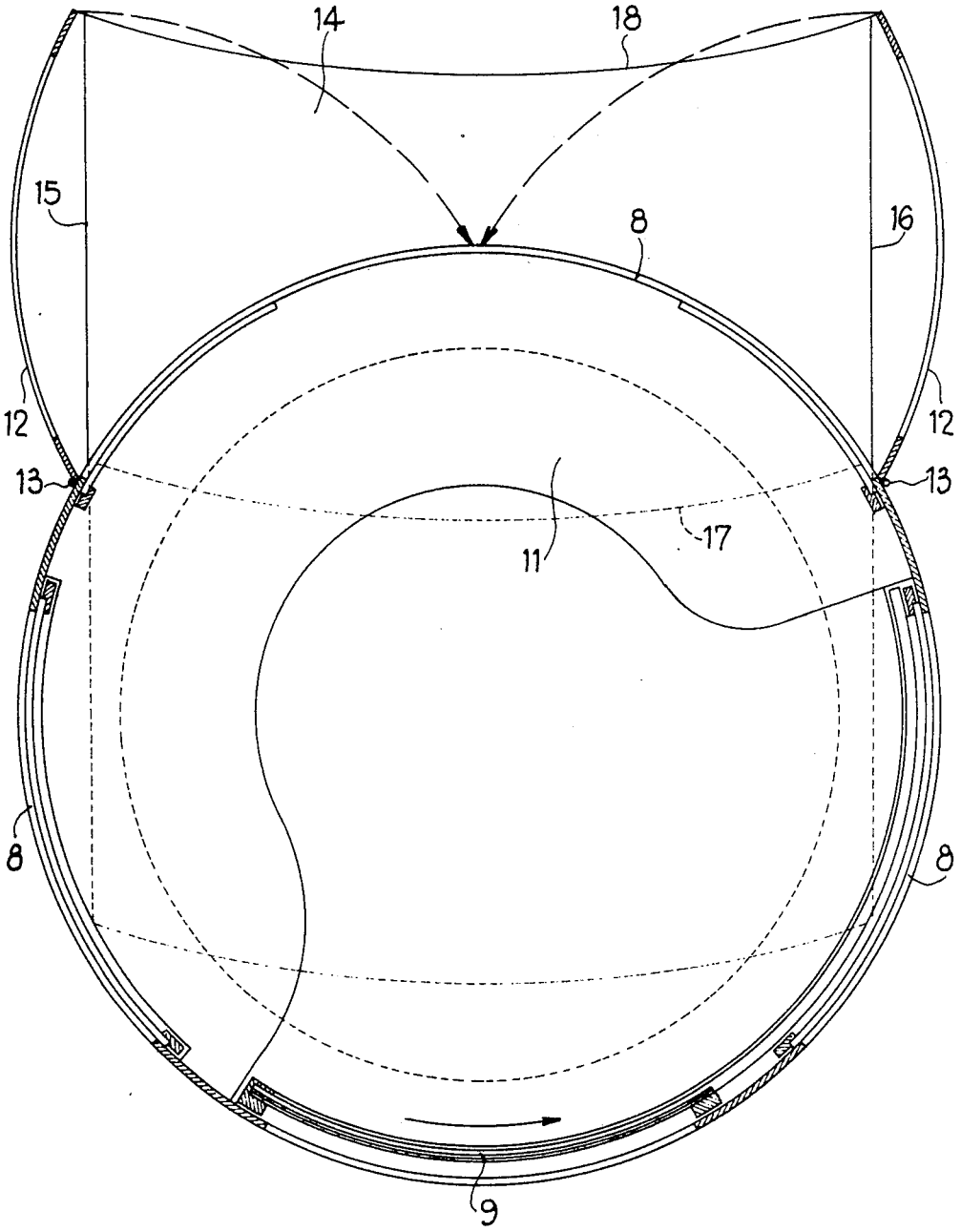
FIGS. 2, 3 and 4 are horizontal sections taken at three levels on the lines II—II, III—III and IV—IV of FIG. 1.

The cell 1 of the sales boutique also comprises an additional horizontal shelf 14 which is removable and can be retracted beneath the sales counter 11 by means of a slit (not shown) of corresponding size formed in the raised front part 15 of the base 5. The shelf 14 can be extended out between the hinged vertical panels 12 in the open position, and retracted inside the body 4 of the cell 1 before the panels are closed. In FIG. 2 is seen a plan view of this shelf in the extended state, which has the shape of a rectangle of which two sides 16, 16*a* are rectilinear and parallel, and the other two sides 17, 18 are curved, the outer side 18 being concave. As will be seen especially in the front sectional view of the cell 1 shown in FIG. 5, the retractable shelf 14 also slides in lateral guides borne by the panels 12.

Figure 3:
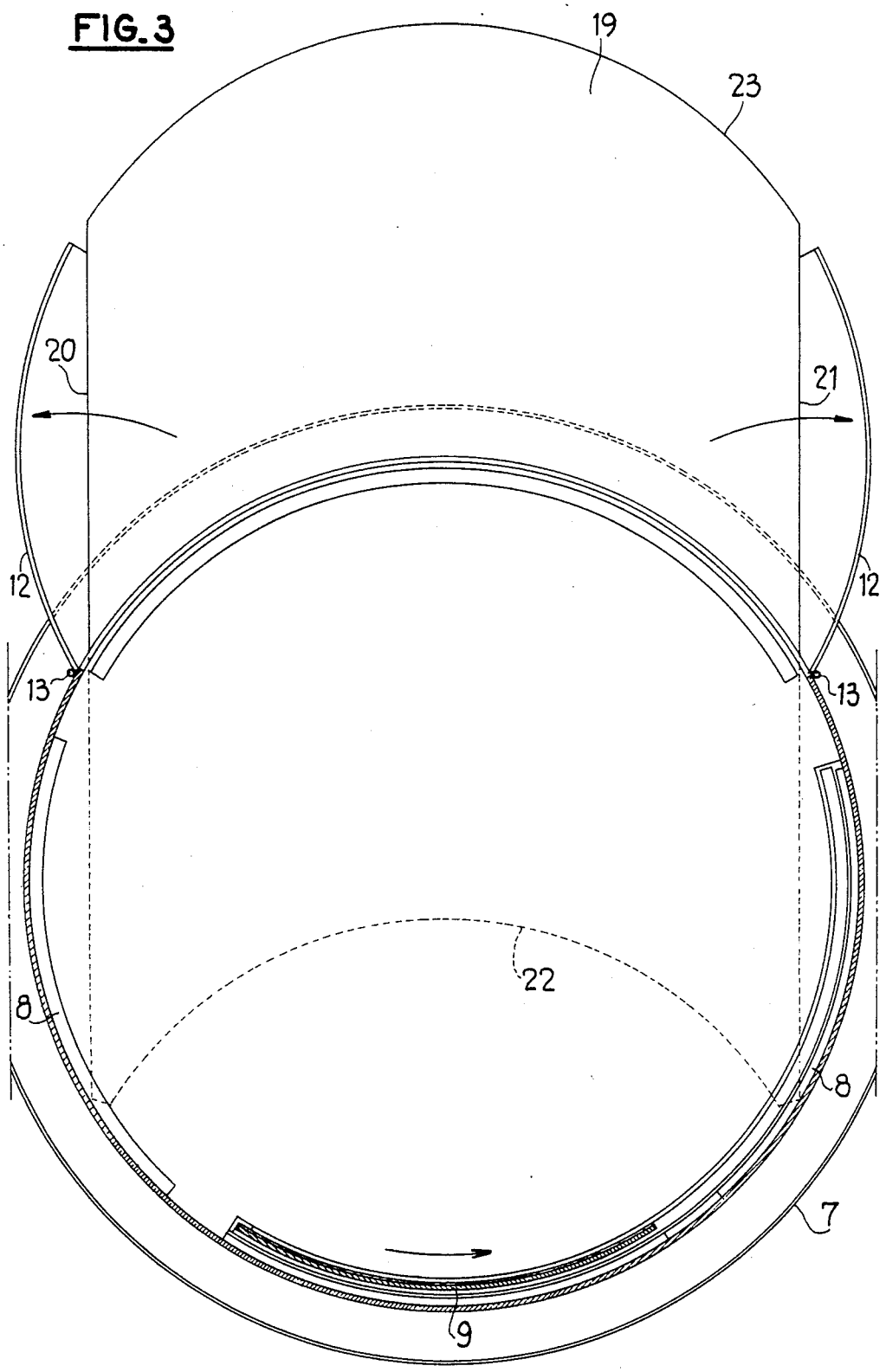
Figure 4:
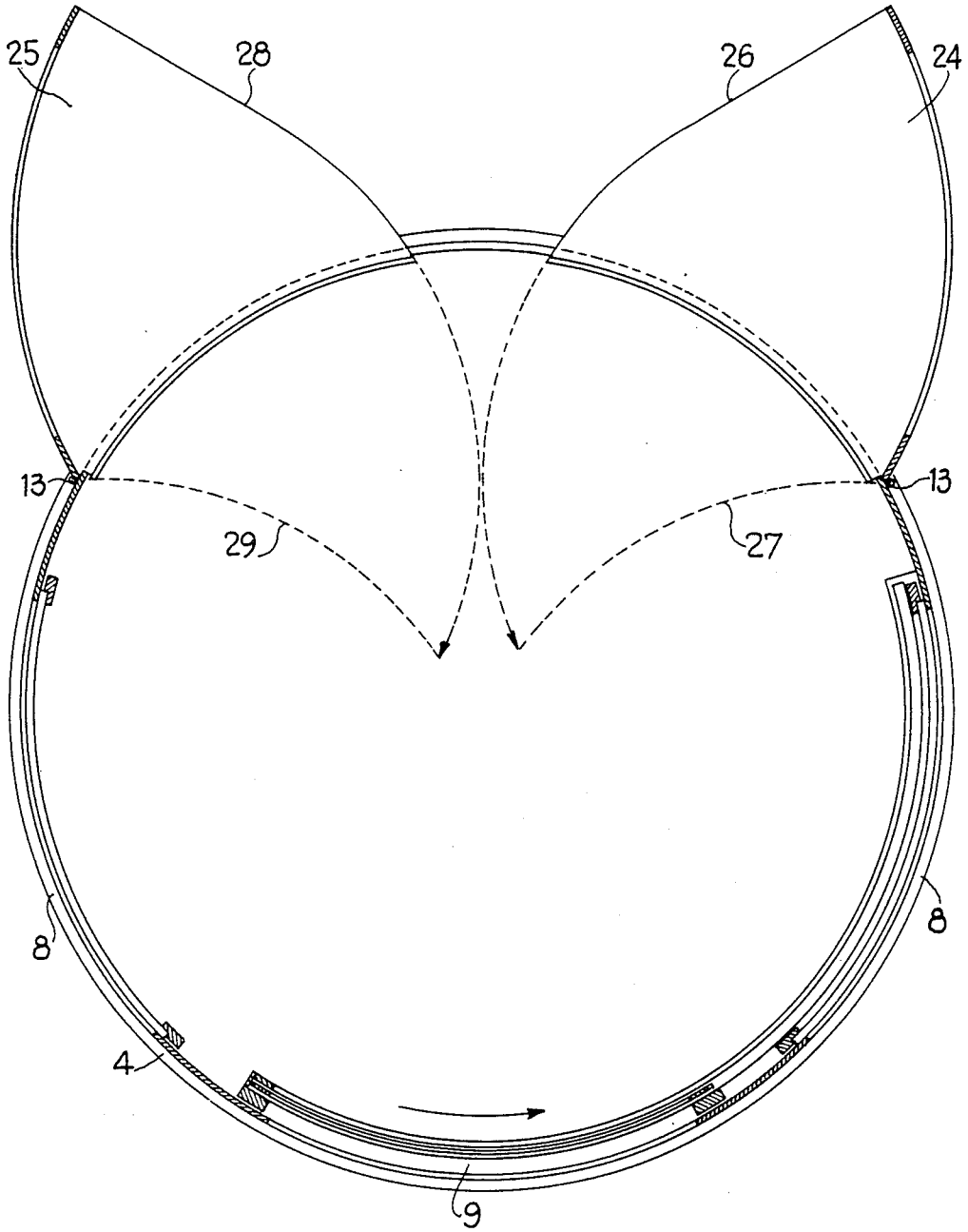
Figure 5:
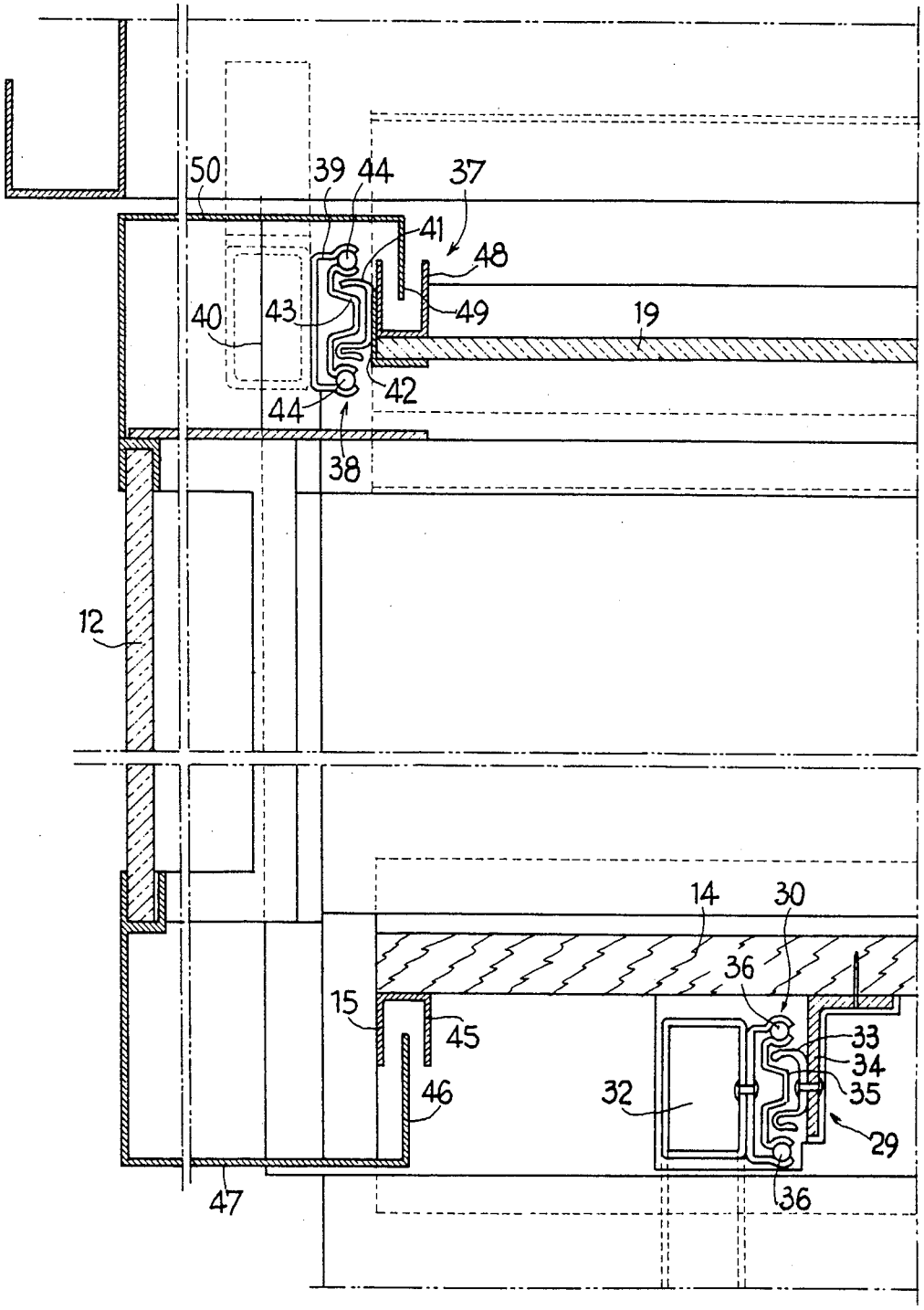
FIG. 5 is a front vertical sectional view on the line V—V of FIG. 1.

The cell 1 also comprises a horizontal removable awning 19 which can be extended out in an open position above the shelf 14 (extended) through a slit (not shown) of suitable size formed in the bottom of the roof member 6 between the panels 12 in the open position and retracted within the body 4 of the cell 1 in the closed position. In FIG. 3 it is seen that the awning has a generally rectangular shape of which two sides 20, 21 are rectilinear and parallel and the other two sides 22, 23 are curved, the side 23 facing outwards being strongly convex so that in the extended position it protects the display and sales space between the open vertical panels 12 from the elements of weather, especially wind and rain. As is also seen in the view of FIG. 5, the awning 19 also slides in lateral guides borne by the panels 12. In its extended position, the awning 19 projects horizontally beyond the front edge of the display shelf 14 for a distance corresponding approximately to the width of at least one person.

The vertical panels 12 also have horizontal shelves 24, 25 on their sides at the height of their lower parts, the shelves 24, 25 having the shape of circular sectors with curved edges 26, 27 and 28, 29 among which the edges 26, 28 are reciprocally adjacent and tangent, within the body of the cell 1, in any position. Naturally, these shelves 24, 25 pass through slots (not shown) of suitable size, formed in the base 5.

Referring to FIG. 5, the description will now be given in more detail of the guide linkages existing between the shelf 14 and the panels 12, and between the awning 19 and the panels, as well as the sliding support systems for the shelf 14 and the awning 19 inside the body 4 of the cell 1.

The additional display shelf 14 is removable and retractable into the body 4 of the cell 1 by means of two systems 30 having triple nested telescopic sliders 30*a*, of which one slider 31 is solid with a support 32 connected to the body 4 of the cell 1 and the other slider 33 is solid with an angle-piece 34 fixed beneath the shelf 14. The slider 33 slides in a third, intermediate slider 35 which travels in the slider 31 by the intermediary of balls or rollers 36.

The awning 19 is removable and retractable into the body 4 of the cell 1 by means of two systems 37 having triple nested telescopic sliders 38 of the same constitution as the systems 30 and of which one slider 39 is solid with a support 40 connected to the body 4 of the cell 1 and another slider 41 is solid with an angle-piece 42 fixed on the awning 19. The slider 41 slides in a third, intermediate slider 43 which travels in the slider 39 by the intermediary of balls or rollers 44.

In the case of the shelf 14 and the awning 19, the supports 32 and 40 extend over the whole inner extent of the body 4 of the cell 1.

In addition, the shelf 14 comprises at each of its side edges 16, 16*a*, a horizontal channel 45 of U-shape in transverse section, which engages onto an edge 46 of an angle-piece 47 borne by the associated adjacent panel 12 so that, when the shelf 14 is extended out, the channel 45 travels on the edge 46 of the angle-piece of the panel and thus maintains the panel in its open position.

Moreover, the awning 19 comprises, at each of its sides 20 and 21, a horizontal channel 48 of U-shape in transverse section, which engages on the edge 49 of an angle-piece 50 borne by the associated adjacent panel 12 so that, when the awning 19 is extended out, the channel 48 travels on the edge 49 of the panel 12, and for this reason maintains the panel in its open position.

Thus each panel 12 is maintained in its open position simultaneously at its bottom and top parts, respectively by the extended shelf 14 and by the extended awning 19, which provides a display and sales space which is safe and protected from the elements of weather between the panels 12 and the awning 19, whereas, when the shelf 14 and the awning 19 are stowed inside the cell 1 and the panels 12 are closed, a unified cylindrically integrated external surface for the complete cell 1 is obtained.

We claim:

1. A sales boutique, especially a newspaper kiosk for exhibiting and selling newspapers and similar publications, of the kind installed on the public highway and consisting of a cell (1) disposed on a plinth (2) and having a door (9), vertical elongate windows (8), and articulated members (12), characterized in that the cell (1) is comprised of articulated members (12) which constitute a part or an entirety of a facade of said cell (1) and which can be brought from a closed position, over said windows (8), whereby said articulated members (12) define a unified external surface integrated with the external surface of the rest of the body (4) of the cell (1), to an open position, whereby said articulated members (12) define and protect a display space, and vice versa, said articulated members having horizontal shelves (24, 25) located on their lower, inner sides, said shelves (24, 25) having the general shape of circular sectors with curved edges (26, 27, 28, 29), the reciprocally adjacent edges (26, 28) of said shelves (24, 25) being tangent inside the body (4) of the cell (1) when the articulated members (12) are in the closed position.

2. A sales boutique, especially a newspaper kiosk for exhibiting and selling newspapers and similar publications, of the kind installed on the public highway and consisting of a cell (1) which has the general shape of a vertical, cylindrical tube disposed on a plinth (2) and having a door (9), vertical elongate windows (8) which constitute a part or an entirety of a facade of said cell (1), and articulated members (12) which constitute a part or an entirety of a facade of said cell (1) and which can be brought from a closed position, over said windows (8), whereby said articulated members (12) define a unified cylindrically integrated external surface with the body (4) of the cell (1), to an open position, whereby said articulated members (12) define the lateral boundaries of a display space, characterized in that the cell (1) further comprises a removable and retractable awning (19) which may be extended horizontally out from the body (4) of the cell (1) between said members (12) when the members (12) are in the open position, whereby said awning (19) defines the vertical ceiling boundary of said display space, and retracted inside the body (4) of the cell (1) before said members (12) are placed in the closed position, said articulated members (12) and said awning (19) defining and protecting a display space when said members (12) are in the open position and said awning (19) is in the extended position.

3. A sales boutique, especially a newspaper kiosk for exhibiting and selling newspapers and similar publications, of the kind installed on the public highway and consisting of a cell (1) disposed on a plinth (2) and having a door (9), vertical elongate windows (8), articulated members (12), and at least one aperture (10) within a window (8), characterized in that the articulated members (12) comprise panels which can be brought from a closed position, over said windows (8), whereby said articulated members (12) define a unified and integrated external surface with the body (4) of the cell (1), to an open position, whereby said articulated members (12) define the lateral boundaries of a display space and provide lateral protection of the display space, said cell (1) further characterized in that the cell (1) further comprises a removable and retractable shelf (14) which may be extended horizontally out from the body (4) of the cell (1) between the articulated members (12) when the members (12) are in the open position, and retracted inside the body (4) of the cell (1) by means of a slit of corresponding size formed in the base (15) of the body (4) of the cell (1) before said members (12) are placed in the closed position.

4. A sales boutique according to claim 1, characterized in that said articulated members (12) are vertical elongate panels connected by hinges (13) having vertical axes to the rest of the body (4) of the cell (1).

5. A sales boutique according to claim 2, characterized in that said articulated members (12) are vertical elongate panels connected by hinges (13) having vertical axes to the rest of the body (4) of the cell (1).

6. A sales boutique according to claim 3, characterized in that said articulated members (12) are vertical elongate panels connected by hinges (13) having vertical axes to the rest of the body (4) of the cell (1).

7. A sales boutique according to claim 4, further comprising a sales counter (11), characterized in that this counter (11) is integral with the body (4) of the cell (1), at the level of the facade which can be opened articulated member (12) horizontally and laterally on the surround inside the cell (1) to define and protect a display area.

8. A sales boutique according to claim 5, further comprising a sales counter (11), characterized in that this counter (11) is integral with the body (4) of the cell (1), at the level of the facade which can be opened or closed by the articulated panels (12), and extends horizontally and laterally on the surround inside the cell (1) to define and protect a display area.

9. A sales boutique according to claim 6, further comprising a sales counter (11), characterized in that this counter (11) is integral with the body (4) of the cell (1), at the level of the facade which can be opened or closed by the articulated panels (12), and extends horizontally and laterally on the surround inside the cell (1) to define and protect a display area.

10. A sales boutique according to claim 6, characterized in that the front edge (18) of the removable and retractable shelf (14) is concave and, in its extended position, is disposed within the display space defined and protected by the articulated panels (12) in the open position.

11. A sales boutique according to claim 2 characterized in that the articulated members (12) have horizontal shelves (24, 25) located on their lower, inner sides, said shelves (24, 25) having the general shape of circular sectors with curved edges (26, 27, 28, 29), the reciprocally adjacent edges (26, 28) of said shelves (24, 25) being tangent inside the body (4) of the cell (1) when the articulated members (12) are in the closed position.

12. A sales boutique according to claim 3, characterized in that the articulated panels (12) have horizontal shelves (24, 25) located on their lower, inner sides, said shelves (24, 25) having the general shape of circular sectors with curved edges (26, 27, 28, 29), the reciprocally adjacent edges (26, 28) of said shelves (24, 25) being tangent inside the body (4) of the cell (1) when the panels (12) are in the closed position.

13. A sales boutique according to claim 2, characterized in that the awning (19) is removable and retractable into the body (4) of the cell (1) by means of two systems (37) having three nested telescopic sliders (38) of which one (39) is integral with the body (4) of the cell (1) by means of a support (40), and another (41) is integral with a support (42) fixed to the awning (19).

14. A sales boutique according to claim 3, characterized in that the shelf (14) is removable and retractable into the body (4) of the cell (1) by means of two systems (30) having three nested telescopic sliders (30*a*) of which one slider (31) is integral with the body (4) of the cell (1) by means of a support (32), and another slider (33) is integral with a support fixed under the shelf (14).

15. A sales boutique according to claim 13, characterized in that the awning (19) further comprises on each of its lateral sides (20, 21), a horizontal channel (48) of U-shape in transverse section, which engages on an edge (49) of an angle piece (50) which is fixed to an associated adjacent articulated member (12) so that, when the awning (19) is in its extended position, it locks the articulated member (12) in its open position by means of the reciprocal engagement of said channel (48) with the edge (49) of the angle piece (50).

16. A sales boutique according to claim 14, characterized in that the shelf (14) further comprises, on each of its lateral sides (15, 16), a horizontal channel (45) of U-shape in transverse section, which engages on an edge (46) of an angle piece (47) which is fixed to an associated adjacent articulated member (12) so that, when the shelf (14) is in its extended position, it locks said associated articulated panel (12) in its open position by means of the reciprocal engagement of said channel (45) with the edge (46) of the angle piece (47).

17. A sales boutique according to claims 1, 2 or 3, further comprising a rotatable sphere (3), characterized in that said sphere (3) is translucent or transparent and mounted on the upper part of the body (4), preferably centered on top of a roof member (6), the facade of said sphere (3) being a the display of advertisements or the name of articles for sale.

18. A sales boutique according to claims 1, 2 or 3, further comprising a gutter (7), characterized in that said gutter (7) is circular and mounted above an awning (19) on the outside of the cell (1).

19. A sales boutique according to claim 1, characterized in that said sales boutique further comprises a removable and retractable awning (19) which may be extended horizontally out from the body (4) of the cell (1) between said articulated members (12) when the articulated members (12) are in the open position, whereby said awning (19) defines the vertical ceiling boundary of said display space, and retracted inside the body (4) of the cell (1) before said articulated members (12) are placed in the closed position, said articulated members (12) and said awning (19) defining and protecting a display space when said articulated members (12) are in the open position and said awning (19) is in the extended position, and a removable and retractable shelf (14) which may be extended horizontally out from the body (4) of the cell (1) between the articulated members (12) when the articulated members (12) are in the open position, and retracted inside the body (4) of the cell (1) by means of a slit of corresponding size formed in the base (15) of the body (4) of the cell (1) before said articulated members (12) are placed in the closed position.

20. A sales boutique according to claim 3, characterized in that said sales boutique further comprises a removable and retractable awning (19) which may be extended horizontally out from the body (4) of the cell (1) between said articulated members (12) when the articulated members (12) are in the open position, whereby said awning (19) defines the vertical ceiling boundary of said display space, and retracted inside the body (4) of the cell (1) before said articulated members (12) are placed in the closed position, said articulated members (12) and said awning (19) defining and protecting a display space when said articulated members (12) are in the open position and said awning (19) is in the extended position.

21. A sales boutique according to claim 7, characterized in that said sales boutique further comprises a removable and retractable awning (19) which may be extended horizontally out from the body (4) of the cell (1) between said articulated members (12) when the articulated members (12) are in the open position, whereby said awning (19) defines the vertical ceiling boundary of said display space, and retracted inside the body (4) of the cell (1) before said articulated members (12) are placed in the closed position, said articulated members (12) and said awning (19) defining and protecting a display space when said articulated members (12) are in the open position and said awning (19) is in the extended position, and a removable and retractable shelf (14) which may be extended horizontally out from the body (4) of the cell (1) between the articulated members (12) when the articulated members (12) are in the open position, and retracted inside the body (4) of the cell (1) by means of a slit of corresponding size formed in the base (15) of the body (4) of the cell (1) before said articulated members (12) are placed in the closed position.

22. A sales boutique according to claim 9, characterized in that said sales boutique further comprises a removable and retractable awning (19) which may be extended horizontally out from the body (4) of the cell (1) between said articulated members (12) when the articulated members (12) are in the open position, whereby said awning (19) defines the vertical ceiling boundary of said display space, and retracted inside the body (4) of the cell (1) before said articulated members (12) are placed in the closed position, said articulated members (12) and said awning (19) defining and protecting a display space when said articulated members (12) are in the open position and said awning (19) is in the extended position.

23. A sales boutique according to claims 2, 8, 19, 20, 21, or 22, characterized in that the front edge (23) of the awning (19) is convex and projects horizontally beyond the front edge (18) of the removable and retractable shelf (14) for a distance corresponding approximately to the width of at least one person.

* * * * *